US005641183A

United States Patent [19]

Diamond

[11] Patent Number: 5,641,183

[45] Date of Patent: Jun. 24, 1997

[54] METHOD AND APPARATUS FOR INHIBITING THE COPYING OF CHECKS AND NEGOTIABLE DOCUMENTS

[75] Inventor: Robert Isador Diamond, Bothell, Wash.

[73] Assignee: Diamond Security, Inc., Alpine, Utah

[21] Appl. No.: 482,426

[22] Filed: Jun. 7, 1995

Related U.S. Application Data

[63] Continuation of Ser. No. 57,614, May 5, 1993, abandoned.

[51] Int. Cl.[6] ..... B42D 15/00

[52] U.S. Cl. ..... 283/58; 283/57; 283/67

[58] Field of Search ..... 283/57, 58, 59, 283/114, 93, 67

[56] References Cited

U.S. PATENT DOCUMENTS

| | | | |
|---|---|---|---|
| 1,383,792 | 7/1921 | Dickinson | 283/114 X |
| 4,210,346 | 7/1980 | Mowry, Jr. et al. . | |
| 4,227,719 | 10/1980 | McElligott et al. . | |
| 4,227,720 | 10/1980 | Mowry, Jr. et al. . | |
| 4,265,469 | 5/1981 | Mowry, Jr. et al. . | |
| 4,310,180 | 1/1982 | Mowry, Jr. et al. . | |
| 4,341,404 | 7/1982 | Mowry, Jr. et al. . | |
| 4,351,547 | 9/1982 | Brooks, II . | |
| 5,085,936 | 2/1992 | Herdman . | |
| 5,149,140 | 9/1992 | Mowry, Jr. et al. . | |
| 5,189,292 | 2/1993 | Batterman . | |
| 5,375,886 | 12/1994 | Tsuchiya . | |
| 5,487,567 | 1/1996 | Volpe . | |

*Primary Examiner*—Willmon Fridie, Jr.

*Attorney, Agent, or Firm*—Michael A. O'Neil; Russell N. Rippamonti

[57] ABSTRACT

A method and apparatus for enhancing the security of a check or negotiable document and deterring the generation of copies of the check or negotiable document. The signature area of a document is imprinted with a pantograph background design different from a pantograph background design covering the remainder of the face of a check. A warning clause describes the color and/or background of the signature area. The endorsement area of a document is also imprinted with a pantograph background design. A warning clause describes the color and/or background of the endorsement area.

16 Claims, 1 Drawing Sheet

METHOD AND APPARATUS FOR INHIBITING THE COPYING OF CHECKS AND NEGOTIABLE DOCUMENTS

This is a continuation of application Ser. No. 08/057,614, filed May 5, 1993, now abandoned.

TECHNICAL FIELD

This invention relates to a method and apparatus for check copying protection, and more particularly to a method and apparatus for protecting the signature and endorsement areas of a check from copying by unauthorized individuals.

BACKGROUND OF THE INVENTION

A major problem within the check cashing industry is the increasing risks arising from the copying of checks by unauthorized individuals, These risks have increased due to the improved technology in the areas of copiers, computer aided design and desk top publishing. Advancements in these areas have created the ability to duplicate checks and other negotiable documents to such a high degree of accuracy that an individual receiving the check or negotiable document has difficulty in determining if the instrument is fraudulent.

A variety of methods have been implemented to protect against the unauthorized copying of checks and negotiable documents. These preventative methods have included the use of multi-colored check faces and specially designed check backgrounds that are not easily copied. Some manufacturers have utilized the placement of the word "void" in a muted design that normally blends in with the background of a check but becomes visible when the check is processed through a single or full color copier. Other manufacturers use a rainbow color scheme with graduated colors from blue to green or blue to purple across the face of a check or negotiable document. The rainbow color scheme makes the check more difficult to photocopy.

However, none of these security methods protect two particularly vital areas of a check or negotiable document. The most critical areas of a check or negotiable document are the signature area and the endorsement area on the back of the check. None of the methods to date have focused upon protection of these particularly vital areas. Thus, a need has arisen for a method and apparatus that specifically protects the vital signature and endorsement areas of a check or negotiable document.

SUMMARY OF THE INVENTION

The foregoing and other problems are overcome by the present invention. The process generates a check or negotiable document wherein the signature area contains several verifications. These include a printed signature area background differing from the background design of the balance of the check. The signature area background may have a single or multi-color background. A warning clause describes the color and/or background design of the signature area, and is printed in a manner such that it is clearly visible prior to and after any unauthorized copying.

As part of the check printing process, verifications are included on the back of the check within the endorsement area. A background design, similar or different to the design on the front of the check, is printed within the check endorsement area. The design may be single or multi-colored and a warning clause is printed alerting payers of the check to the background and/or color scheme of the endorsement area, and is printed in a manner such that it is clearly visible prior to and after any unauthorized copying.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
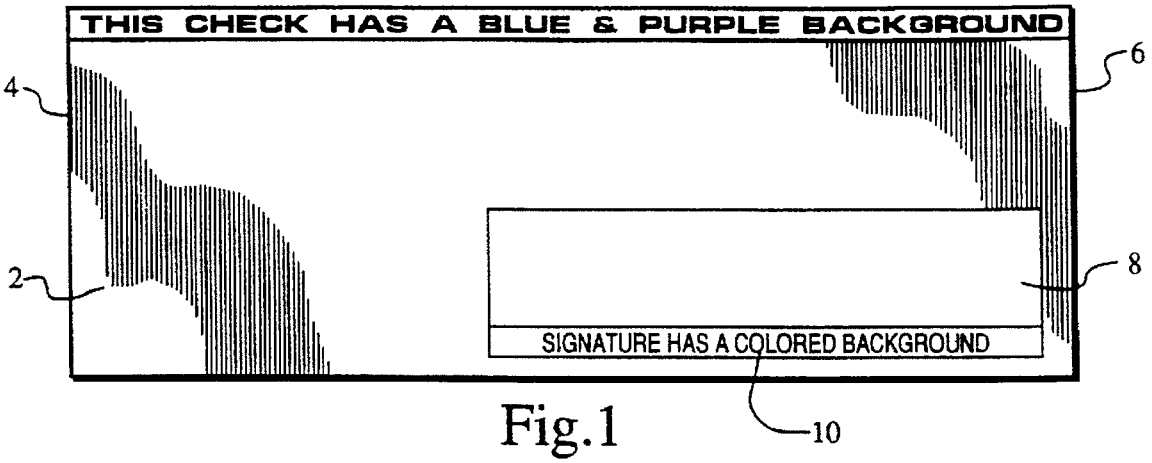
FIG. 1 illustrates the front side of a check utilizing the signature area of the present invention.

Referring now to the Drawings, and more particularly to FIG. 1, there is illustrated the front side of a check utilizing the signature area of the present invention. The check comprises a substantially rectangular sheet of paper having a check face 2, covered with a pantograph background design. As the pantograph background design proceeds from the left side 4 of the check to the right side 6 of the check, the color graduates from one color to other colors, for example, from blue to green or blue to purple. The signature area 8 of the check, comprises an area having a pantograph background design different from the design encompassing the majority of the face 2 of the check. Furthermore, as you proceed from the left side of the signature area to the right side of the signature area, a graduated color change can occur.

A warning clause 10 is placed in the signature area 8 indicating that the signature area has a colored background. The warning clause may also include an indication of the differing background within the signature area 8 or describe any other relevant feature of the signature area. The warning clause 10 uses a background and print that is clearly visible prior to and after any unauthorized copying. In the preferred embodiment, this would be achieved by using a solid color background, as opposed to a pantograph background design, with the warning clause 10.

Figure 2:
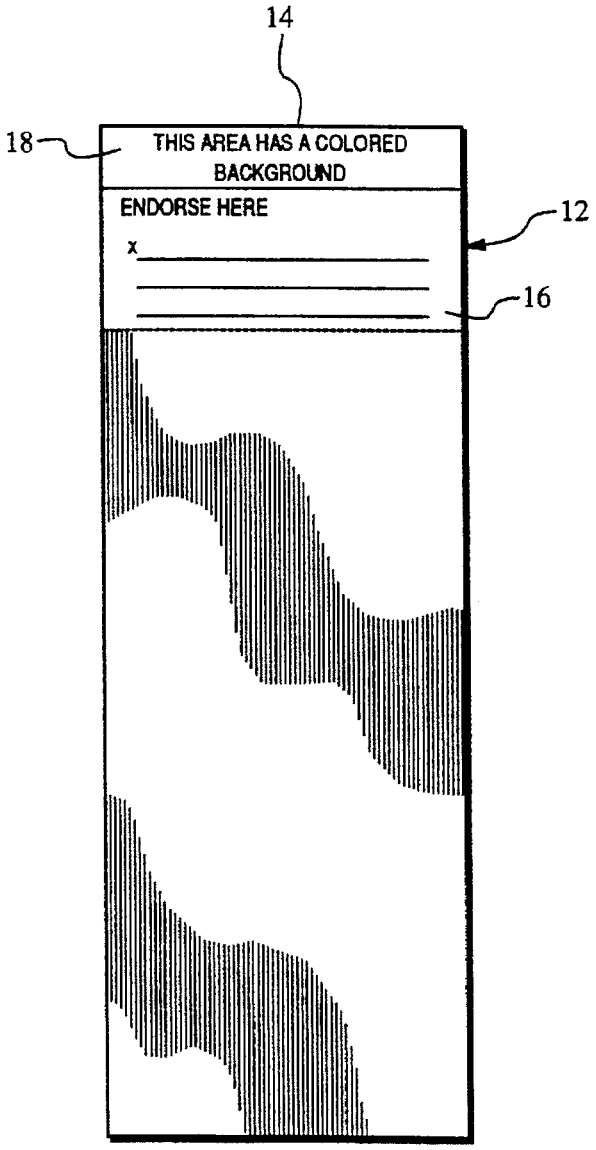
FIG. 2 is an illustration of the back of a check utilizing the endorsement area of the present invention.

Referring now to FIG. 2, there is shown the back of a check having an endorsement area printed or manufactured in accordance with the present invention. The endorsement area 12 comprises an area located at the top edge 14 of the check. The face 16 of the endorsement area 12 is covered by a pantograph background design similar to the pantograph background design on the face 2 of the check. The pantograph background design may be a single color or alternatively, may have multi-colors fading from one color to the other colors across the face 16 of the endorsement area 12.

A warning clause 18 across the top of the endorsement area 12 describes the color and/or background of the endorsement area. The warning clause 18 may further describe any relevant aspect of the endorsement area 12 and the face of check 2. The warning clause 18 is printed using a background and print that is clearly visible prior to and after any unauthorized copying. In the preferred embodiment, this would be achieved by using a solid color background, as opposed to a pantograph background design, with the warning clause 18. While the description with respect to FIGS. 1 and 2 were made with respect to a check, it is to be understood that the invention is applicable to any negotiable document.

Figure 3:
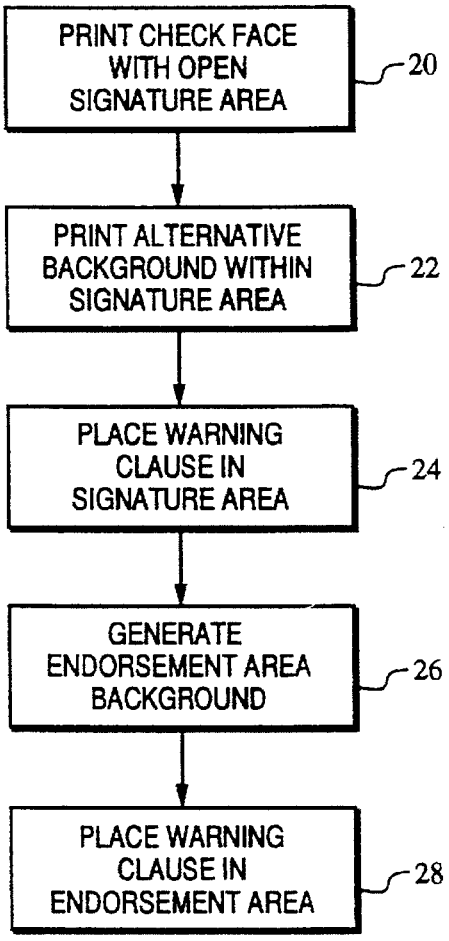
FIG. 3 is a flow diagram describing the process of the present invention.

Referring now to FIG. 3, there is shown a block diagram illustrating the process of the present invention. The check face is printed at step 20. At step 22, the signature area is also printed with an alternative background and a color scheme similar to that of the remainder of the face of the check. At step 24, the warning clause is placed in the signature area of the check to describe the background and/or color of the signature area. The endorsement area background is generated at step 26 within the endorsement area to have a pantograph background design similar to the design on the front of the check. A warning clause is placed at step 28 in the endorsement area of the check to describe the background and/or color of the endorsement area.

Although a preferred embodiment of the present invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A negotiable document having enhanced security for deterring the generation of counterfeit photocopies of the negotiable document, said negotiable document comprising:

a front face;

a signature area located on the front face;

a first pantographic background design creating a seemingly random background covering a first area of the negotiable document; and a second pantographic design creating a seemingly random background covering the signature area of the negotiable document; and a warning clause, located in the signature area, having a background and print that is visible prior to and after any photocopying of the negotiable document and describing the second pantographic design of the signature area.

2. The negotiable document in accordance with claim 1 wherein the first pantographic background design is a first color and the second pantographic design is a second color and the first color differs from the second color.

3. The negotiable document in accordance with claim 1 wherein the first pantographic background design is multicolored and the first pantographic background design changes color from a first color to a second color from one point to another point on the negotiable document.

4. The negotiable document in accordance with claim 1 further comprising:

a endorsement area on the back face; and a third pantographic design covering the endorsement area of the negotiable document.

5. The negotiable document in accordance with claim 4 wherein the first pantographic background design differs in color from the second pantographic design.

6. A negotiable document having enhanced security for deterring the generation of counterfeit photocopies of the negotiable document, said negotiable document comprising:

a front face;

a back face;

a signature area located on the front face;

a first pantographic background design creating a seemingly random background covering a first area of the negotiable document; and a second pantographic design creating a seemingly random background covering the signature area of the negotiable document;

an endorsement area on the back face;

a third pantographic design covering the endorsement area of the negotiable document;

a first warning clause ,located in the signature area, having a background and print that is visible prior to and after any photocopying of the negotiable document and describing the second pantographic design of the signature area; and a second warning clause, located in the endorsement area, having a background and print that is visible prior to and after any photocopying of the negotiable document and describing the third pantographic design of the endorsement area.

7. A negotiable document having enhanced security for deterring the generation of counterfeit photocopies of the negotiable document, the negotiable document comprising:

a front face;

a back face;

a signature area on the front face;

an endorsement area on the back face:

a first pantographic design covering substantially the signature area;

a second pantographic design covering a background area of the front face and differing from the first pantographic design; and a third pantographic design covering substantially the endorsement area;

wherein the second and third pantographic designs create a seemingly random background in the signature area and the endorsement area to render the areas covered by them incapable of exact copying when processed by photocopying devices.

8. The negotiable document in accordance with claim 7 wherein the first pantographic background design covers substantially the front face of the negotiable document except for the signature area.

9. The negotiable document in accordance with claim 7 further comprising a second pantographic background design covering a substantial area of the back face of the negotiable document and differing from the second pantographic design of the endorsement area.

10. The negotiable document in accordance with claim 9 wherein the color of the first pantographic background design differs from the color of the first pantographic design of the signature area and the color of the second pantographic background design differs from the color of the second pantographic design of the endorsement area.

11. A negotiable document having enhanced security for deterring the generation of counterfeit copies of the negotiable document, said negotiable document comprising:

a front face;

a back face;

a signature area on the front face;

an endorsement area on the back face:

a first pantographic design covering substantially the signature area;

a second pantographic design covering substantially the endorsement area; and a first pantographic background design covering an area of the front face and differing from the first pantographic design of the signature area, wherein the pantographic designs create a seemingly random background in the signature area and the endorsement area to render the areas covered by them incapable of exact copying when processed by photocopying devices;

a first warning clause, located in the signature area, having a background and print that is visible prior to and after any photocopying of the negotiable document and describing the first pantographic design of the signature area; and a second warning clause, located in the endorsement area, having a background and print that is visible prior to and after any photocopying of the negotiable document and describing the second pantographic design of the endorsement area.

12. A method for enhancing the security of a negotiable document having a front face and a back face and for deterring the copying of the negotiable document, comprising the steps of:

generating a negotiable document having a first pantographic background design covering substantially the entire front face of the negotiable document except for a signature area on the front face; and printing a first pantographic background design within the signature area different from the first pantographic background design on the front face wherein said pantographic designs create a seemingly random background and render any areas covered by said pantographic designs incapable of exact copying when processed by a copying device.

13. The method in accordance with claim 12 further comprising the step of generating on the negotiable document a first warning clause having a background and print that is visible prior to and after any copying of the negotiable document and describing the first pantographic background design of the signature area.

14. The method in accordance with claim 13 further comprising the step of printing a second pantographic design within an endorsement area on a back side of the negotiable document.

15. The method in accordance with claim 14 further comprising the step of generating on the negotiable document a second warning clause having a background and print that is visible prior to and after any copying of the negotiable document and describing the second pantographic background design of the endorsement area.

16. The method in accordance with claim 14 wherein the first pantographic background design and the first pantographic design and the second pantographic design are each a different color.

* * * * *